US006715309B1

(12) United States Patent
Junkins

(10) Patent No.: US 6,715,309 B1
(45) Date of Patent: Apr. 6, 2004

(54) COOLING APPARATUS

(76) Inventor: Richard Junkins, 11623 Wall Triana, Ardmore, AL (US) 35739

( * ) Notice: Subject to any disclaimer, the term of this patent is extended or adjusted under 35 U.S.C. 154(b) by 0 days.

(21) Appl. No.: 10/274,875

(22) Filed: Oct. 22, 2002

(51) Int. Cl.[7] ..... F25D 23/12; F25D 3/02
(52) U.S. Cl. ..... 62/259.3; 62/459
(58) Field of Search ..... 62/359.3, 459, 62/426, 425, 420, 406

(56) References Cited

U.S. PATENT DOCUMENTS

| | | | | | |
|---|---|---|---|---|---|
| 3,391,407 | A | | 7/1968 | Waters | |
| 3,548,415 | A | | 12/1970 | Waters | |
| 3,736,764 | A | * | 6/1973 | Chambers et al. | 62/89 |
| 3,813,696 | A | | 6/1974 | Yeager | |
| 4,459,822 | A | * | 7/1984 | Pasternack | 62/259.3 |
| 4,691,762 | A | | 9/1987 | Elkins et al. | |
| 4,744,106 | A | * | 5/1988 | Wang | 2/7 |
| 5,146,757 | A | * | 9/1992 | Dearing | 62/61 |
| 5,246,061 | A | * | 9/1993 | Zalite | 165/10 |
| 5,261,399 | A | | 11/1993 | Klatz et al. | |
| 5,386,823 | A | * | 2/1995 | Chen | 128/204.15 |
| 5,762,129 | A | * | 6/1998 | Elliott | 165/48.1 |
| 5,806,335 | A | * | 9/1998 | Herbert et al. | 62/434 |
| 5,967,225 | A | * | 10/1999 | Jenkins | 165/46 |
| 6,122,773 | A | | 9/2000 | Katz | |
| 6,170,282 | B1 | * | 1/2001 | Eddins | 62/259.3 |
| 6,178,562 | B1 | * | 1/2001 | Elkins | 2/458 |
| 6,336,341 | B1 | * | 1/2002 | McGraw et al. | 62/420 |

* cited by examiner

*Primary Examiner*—William C. Doerrler
(74) *Attorney, Agent, or Firm*—Dykema Gossett PLLC

(57) ABSTRACT

A cooling apparatus includes a base unit in the form of an insulated tank that defines a refrigerant chamber therein for refrigerant, a discharge unit for discharging a flow of air, and a closed circulation system for transferring coolness from the refrigerant in the refrigerant chamber to the air flow in the discharge unit, the circulation system including a first tube coil in the refrigerant chamber, and second tube coil in the discharge unit, a pump, and hoses for conveying coolant from the first tube coil to the second tube coil and back to the pump. The base unit can be harnessed to a user as a backpack and the discharge unit can be a helmet worn by the user, the hoses connected therebetween being flexible. The refrigerant supplied to the refrigerant chamber can be ice and the coolant flowing through the closed circulation system can be water.

20 Claims, 3 Drawing Sheets

COOLING APPARATUS

BACKGROUND OF THE INVENTION

1. Field of the Invention

The present invention relates to cooling apparatus for use in cooling individuals or groups of people.

2. The Prior Art

Cooling apparatus such as portable cooling apparatus for cooling people are well known. For example, in U.S. Pat. No. 6,178,562 to Elkins an apparatus is disclosed which includes a temperature control unit, a cap which contains air and fluid bladders, a vest which contains air and fluid bladders, and air and fluid tubes which extend from the temperature control unit to the cap, from the cap to the vest, and from the vest back to the temperature control unit so as to separately convey air and cooled liquid to the cap and to the vest to fill the bladders therein, the cooled liquid flowing through the cap and the vest cooling the head and torso of the user. The temperature control unit can be moved to desired locations of use.

Other portable personal cooling apparatus are disclosed in U.S. Pat. No. 4,691,762 to Elkins et al. and U.S. Pat. No. 6,170,282 to Eddins. Hats or helmets for cooling the heads of users are shown in U.S. Pat. No. 3,548,696, U.S. Pat. No. 3,813,696, U.S. Pat. No. 4,172,495 and U.S. Pat. No. 6,122,773.

However, the prior art cooling apparatus, due to their constructions, are quite inefficient or complicated in construction, and cannot maintain their cooling function for more than a short period of time.

It is an object of the present invention to provide a cooling apparatus which is much more efficient than known apparatus of this type and will operate to cool a person or groups of people for long periods of time, e.g., up to 2 hours, depending on ambient conditions.

SUMMARY OF THE INVENTION

According to this invention, the cooling apparatus includes an insulated base unit for containing supplied refrigerant such as ice, a discharge unit for discharging cooled air, and a closed coolant circulating system extending between the base unit and the discharge unit, the coolant in the circulating system being cooled in the base unit by the refrigerant supplied thereto and then circulated to the discharge unit in order to cool air flowing therethrough, and then circulated back to the base unit.

The closed circulating system includes a first tube coil in a refrigerant chamber in the base unit, the first tube coil exposing a large surface area to the refrigerant, e.g., ice, in the refrigerant chamber so as to enable efficient transfer of coolness from the refrigerant to the coolant flowing through the tube coil. The closed circulation system also includes a second tube coil in the discharge unit to enable efficient transfer of coolness from the coolant flowing therethrough to air passing over the tube coil. The closed circulation system also includes a first connecting tube, preferably a flexible hose, which extends from the base unit to the discharge unit to convey coolant from the first tube coil to the second tube coil, and a second connecting tube, preferably a flexible hose, which extends between the discharge unit and the base unit to return coolant to the base unit. A pump is preferably positioned in the base unit to circulate the coolant in the closed circulation system.

In a first preferred embodiment the base unit is in the form of a relatively small insulated tank which can be worn by a user as a backpack and the discharge unit is in the form of a helmet which is worn by the user, the helmet including a fan for circulating air over the second tube coil therein and onto the head of the user.

In another preferred embodiment the base unit is a larger insulated tank which can be positioned on a cart and the discharge unit is a downwardly-open hood which is mounted on a movable boom, the hood being large enough to cool a plurality of people therebelow. In a modification, the base unit can be placed on a vehicle such as a golf cart and the hood can be mounted on the roof of the golf cart so as to cool golfers in or adjacent the cart at any location along the golf course.

The tube coils of the closed circulation system are made of material which have good heat/coolness transfer properties, and can include rubber, plastic and metals. Copper is especially preferred.

The invention will now be better understood by reference to the attached drawings taken in conjunction with the following discussion.

DETAILED DESCRIPTION OF THE PREFERRED EMBODIMENTS

Figure 1:
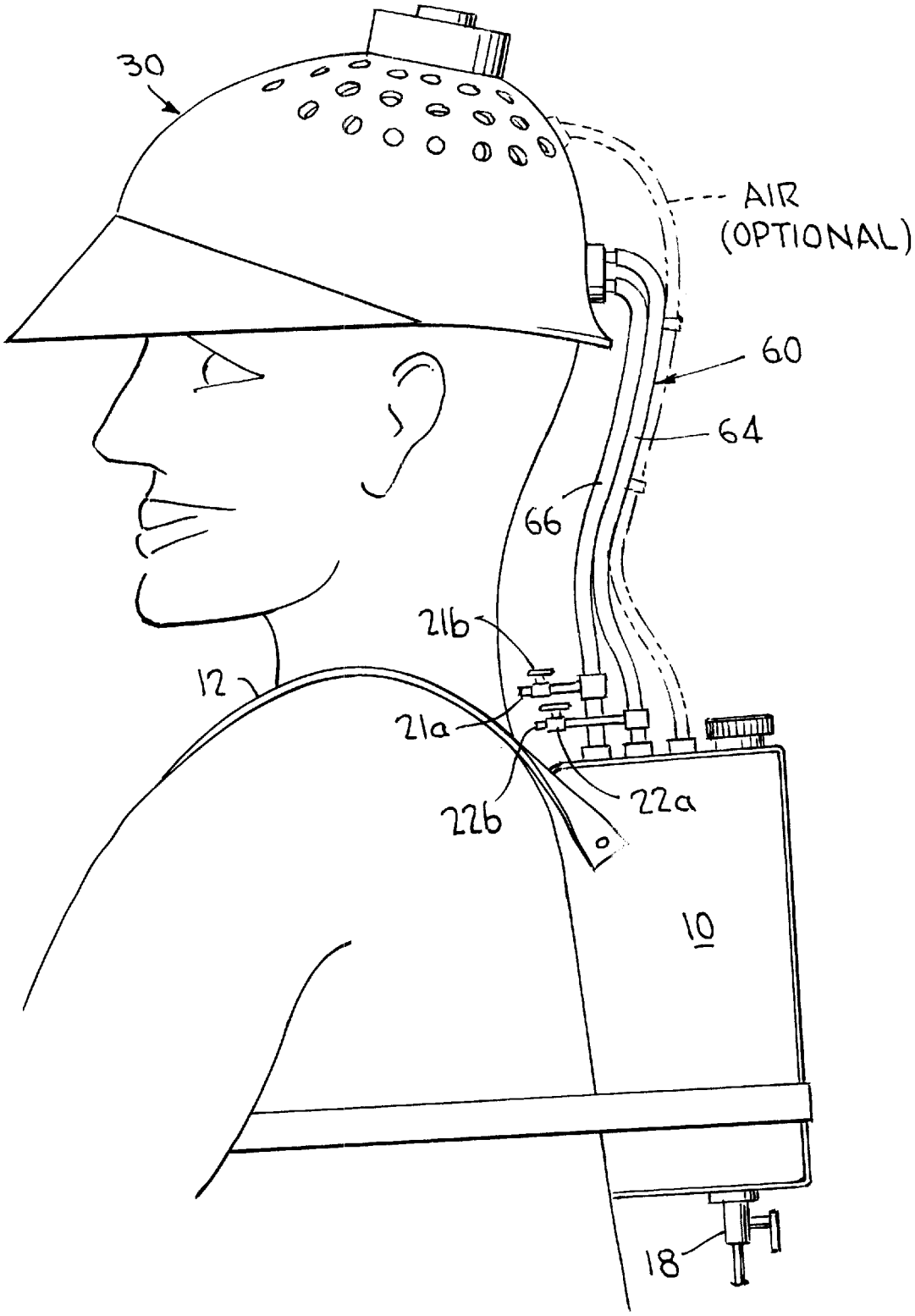
FIG. 1 shows a cooling apparatus according to a first preferred embodiment of the invention, the cooling apparatus being worn by a user and including a base unit worn by the user as a backpack, a discharge device in the form of a helmet, and coolant circulation system.
Figure 3:
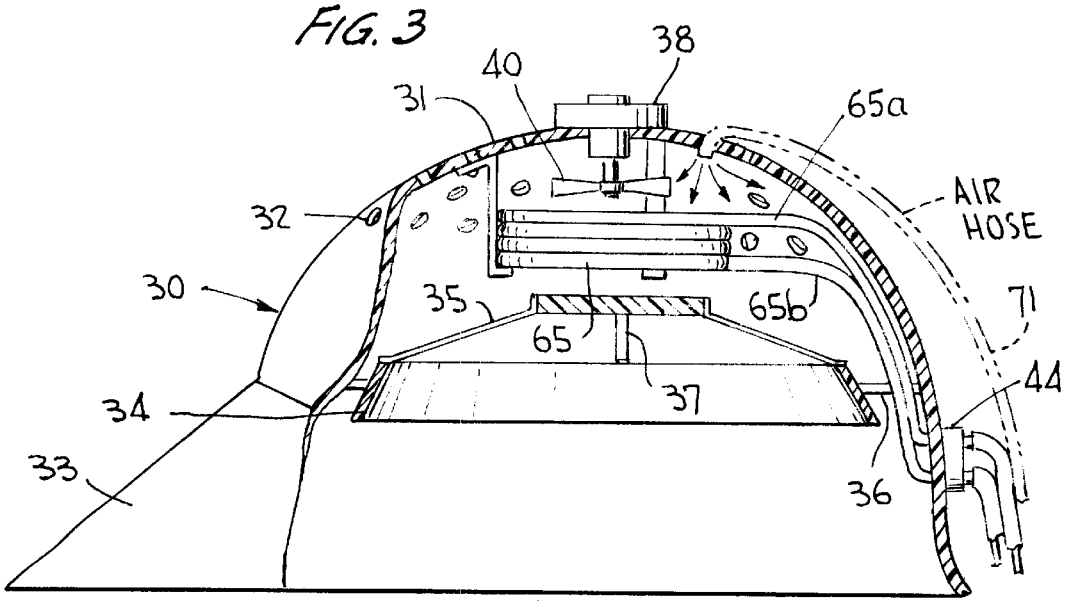
Figure 2:
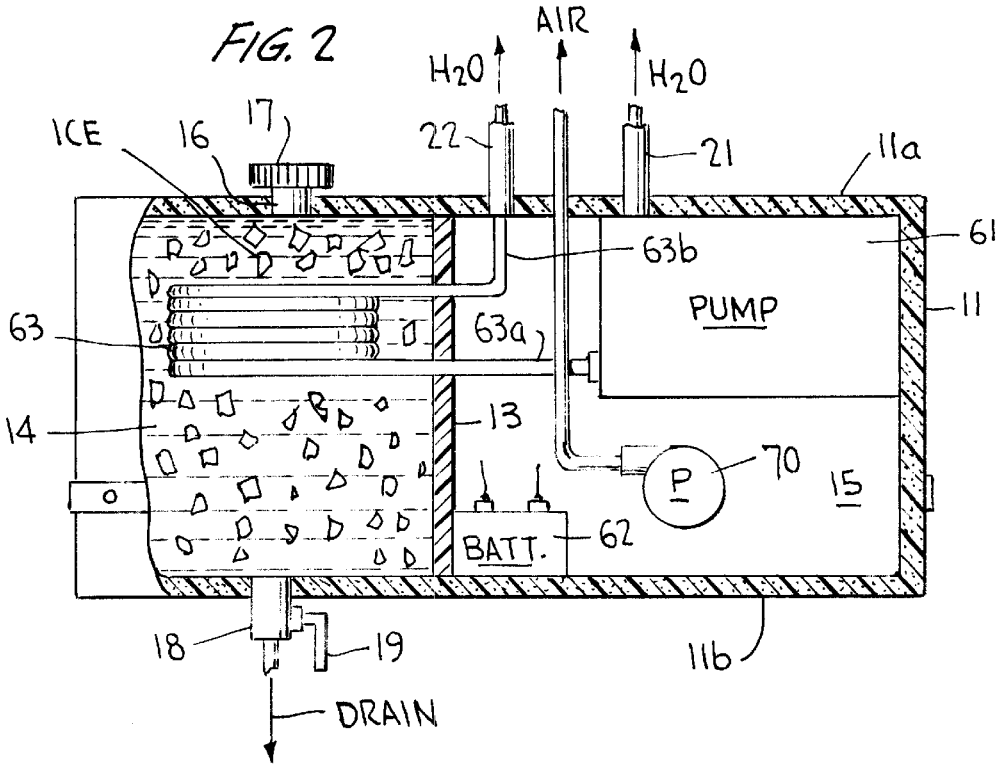
FIG. 2 shows a rear view of the base unit of FIG. 1, with the rear wall broken away to show the elements inside, FIG. 3 show a side view of the helmet of FIG. 1, with the side portion broken away to display the elements inside.

FIGS. 1–3 depict a first preferred embodiment of cooling apparatus according to the present invention. It is designed to be worn by a user who desires to have his (or her) head, neck and shoulders cooled as he (or she) moves about. The cooling apparatus includes a base unit 10, a discharge device in the form of a helmet 30, and a closed coolant circulation system 60 for transferring coolness from the base unit to the helmet. As will be discussed below, the coolant circulation system includes a pump 61, first and second tube coils 63 and 65, and flexible hoses 64 and 66.

Referring to FIGS. 1 and 2, the base unit 10 includes an insulated tank 11 which is mounted on the back of a user by a harness 12 that extends over the user's shoulders and around his (or her) chest. The insulated tank, which can be composed of rubber-coated styrofoam or any other commonly used insulating material, includes an internal wall 13 that divides the interior of the tank into a refrigerant chamber 14 and a pump chamber 15. A threaded opening 16 in the tank top wall 11*a* provides access to the refrigerant chamber 14 and enables refrigerant such as crushed, cubed or chunk ice to be supplied therein. A threaded cap 17 can be screwed into the opening 16 to close access to the chamber. A drain valve 18 with control lever 19 is positioned in the tank floor 11*b* of the insulated container to provide for drainage of liquid from the chamber 14.

The pump chamber 15 houses a pump 61 of the coolant circulation system 60, as well as its energy source (battery)

62. The pump 61 is activated by a suitable switch (not shown) on the side, top or bottom of the tank.

An inflow T-connector 21 with side branch 21*a* and valve 21*b* is located in the top wall 11*a* of the tank 11 and connects the return hose 66 of the coolant circulation system to an intake port of the pump 61. An outflow T-connector 22 with side branch 22*a* and valve 22*b* is located in the top wall 11*a* for connecting the first tube coil 63 of the coolant circulation system to the outflow hose 64.

The first tube coil 63 of the coolant circulation system is a helical coil and is located in the refrigerant chamber 14 so that its axis is aligned with the opening 16, and it includes a inlet branch 63*a* which extends through the internal wall 13 to connect with an output port of the pump 61. An outlet branch 63*b* extends through the internal wall 13 and connects with the second T-connector 22. The first tube coil 63 is made of a material having good heat and coolness transfer properties, and can include rubber, plastics and metals, preferably copper.

Turning now to FIGS. 1 and 3, the helmet 30 is formed of a rigid dome 31 having holes 32 therein and a front brim 33. A rigid head band 34 having a conical upper portion 35 is mounted within the dome by brackets 36. An adjustable positioner 37 is located within the conical upper portion for adjusting the height of the dome 31 above the top of the user's head. A fan which includes a motor 38 is mounted in the dome so that its shaft 39 extends downwardly into the interior of the dome, and a fan blade 40 is attached to the shaft 39 so that when rotated, it will circulate air downwardly over the conical upper portion 35 of the head band 34 and to the interior periphery of the dome, and then downwardly over the face, ears, neck and shoulders of the user. The motor 38 is preferably battery operated, although it can be powered by alternative power sources such as solar cells mounted on the dome (not shown). It is turned on and off a suitable switch (not shown).

Brackets 41 extend downwardly from the interior of the dome 31 to support the second tube coil 65 of the coolant circulation system beneath the fan blade 40, shown as a helical coil. The intake branch 65*a* of the second tube coil 65 extends downwardly to a tube connector 44 in the back of the dome 31, as does the outlet branch 65*b*. The second tube coil 65 is made of a material having good heat and coolness transfer properties, and can include rubber, plastics and metals, preferably copper.

As best seen in FIG. 1, the coolant circulation system includes a first connecting tube in the form of a flexible outflow hose 64, preferably made of rubber, which is connected between the outflow T-connector 22 and the tube connector 44, and a second connecting tube in the form of a flexible return hose 66, preferably made of rubber, which is connected between the tube connector 44 and the inflow T-connector 21. These hoses, together with the first and second tube coils 63, 65 and the pump 61, help provide the closed coolant circulation system 60. The closed circulation system can be filled with coolant such as water by connecting a supply hose to the side branch 21*a* of the T-connector 21, opening the valves 21*b* and 22*b*, and then flowing the coolant into the T-connector 21 until it fills the system and eventually flows out the side branch 22*a*, after which the valves 21*b* and 22*b* are closed. Alternatively, the supply hose can be connected to the side branch 22*a* of T-connector 22, the valves 22*b* and 21*b* opened, the coolant allowed to flow into the system to fill it, and then the valves 22*b* and 21*b* closed. Coolant can be drained from the system in a reverse manner.

In operation, with the coolant circulation system filled with coolant, refrigerant such as ice is supplied to the refrigerant chamber 14 in the base unit 11 via the opening 16 so as to surround the tube coil 63, and the cap is screwed into the opening 16 to close it. The pump 61 and the motor 38 are activated so that the coolant such as water flows through the coolant circulation system 60 and air is blown over the tube coil 65. The coolant flowing though the tube coil 63 will be cooled by the refrigerant surrounding the tube coil 63 and the coolant will flow up through the flexible hose 64 to the tube coil 65 where it will cool the air flowing the repast and around the head band 34 and onto the head, neck and shoulders of the user. The coolant will then flow back to the pump 61 via flexible hose 66, and on again to the tube coil 63. The apparatus will continue to operate successfully until the battery 62 fails, or the power supply to motor 38 fails, or the refrigerant in the refrigerant chamber 14 warms to ambient temperature and can no longer transfer coolness to the coolant flowing though the tube coil 63. The use of the tube coil 63 in the refrigerant chamber 14 provides for excellent coolness transfer from the refrigerant to the coolant flowing therethrough due to the large surface area of the tube coil exposed to the refrigerant.

It should be noted that a suitably powered air pump 70 can be positioned in the pump chamber 15 to forcibly supply air through flexible hose 71 to the dome 31 for enhanced air flow.

Figure 4:
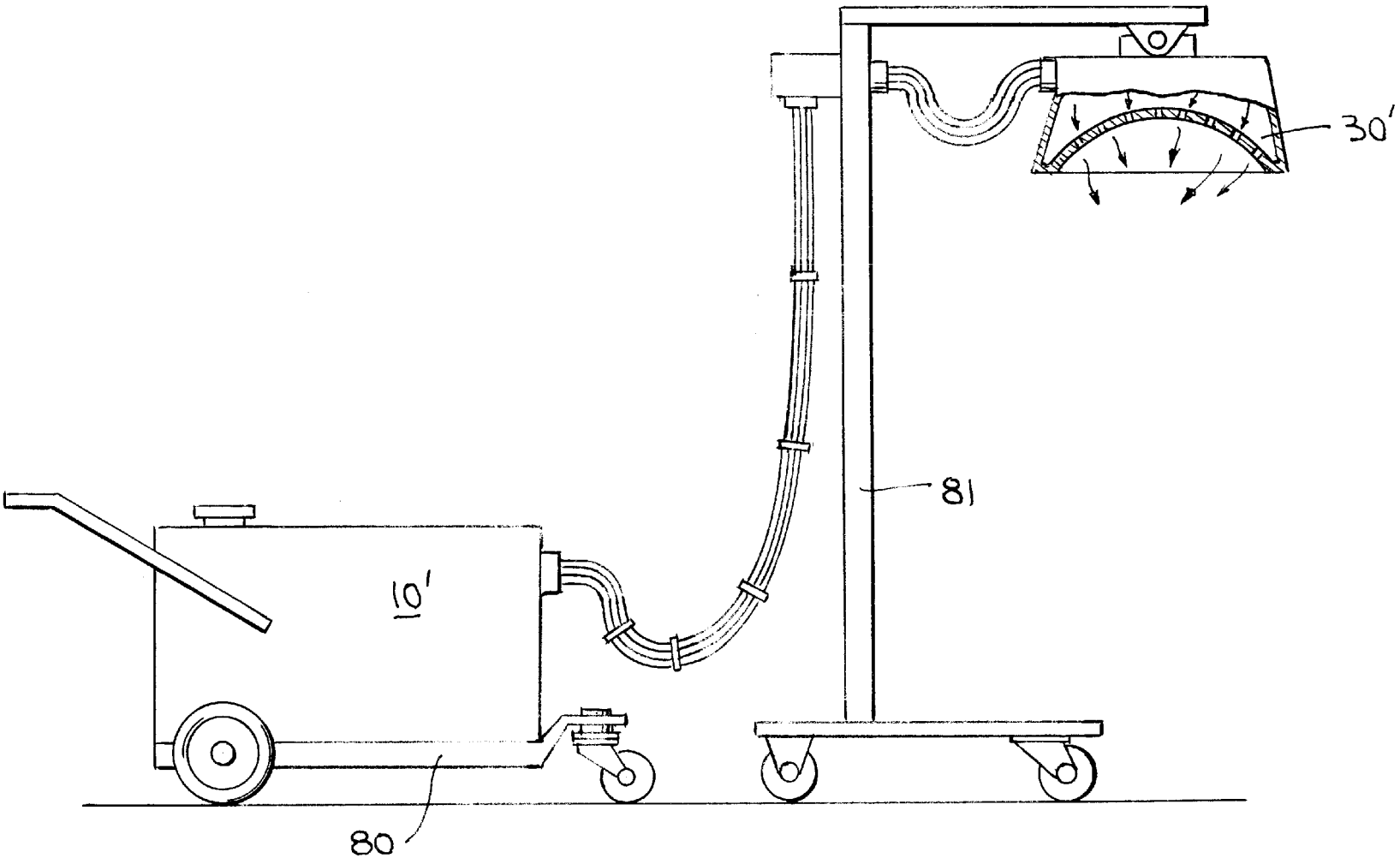
FIG. 4 shows a second preferred embodiment of the inventive cooling apparatus which is movable to a desired location for multi-person use.

Turning now to FIG. 4, an alternative embodiment of the invention is shown wherein the base unit 10' is much larger than the base unit of FIGS. 1–3 and is positioned in a movable cart 80. Hoses 64' and 66', which correspond to hoses 64 and 66 in the FIG. 1–3 embodiment, connect the base unit with a downwardly-open hood 30' mounted on a movable boom device 81. The hood 30' corresponds with the helmet 30, but is larger in volume and can be used to cool a plurality of people at any desired location. In this embodiment the pump (not shown) in the base unit 10' and the motor (not shown) in the hood 30' can be of the type powered by AC current as the apparatus is intended to be used in a particular location for a period of time and may be near an AC outlet.

In another embodiment (not shown) the base unit 10' can be located on a vehicle such as a golf cart and the hood 30' can be mounted on the roof of the vehicle or on a boom mounted on the vehicle to cool the occupants while sitting in or standing near the vehicle.

Although multiple embodiments of the invention have been now shown and described in detail, various modifications therein can be made and still fall within the scope of the appended claims. For example, multiple tube coils connected in series can be positioned in the refrigerant chamber 14 to achieve even greater transfer of coolness to the coolant flowing therethrough. The pump for the coolant can be located other than inside the tank.

I claim:

1. A cooling apparatus which comprises:

a base unit which includes an insulated container that provides a refrigerant chamber therein, a helmet which defines an outlet opening and which includes a fan therein for creating air flowing out of said outlet opening, and a closed coolant circulation system for transferring coolness from refrigerant in said refrigerant chamber to the air flowing out of said helmet, said closed coolant circulation system comprising a first tube coil in said refrigerant chamber a second tube coil in said helmet between said fan and said outlet opening, said second tube coil being helical; first and second connecting tubes extending between said base unit and said helmet; and a pump for circulating liquid coolant through said first tube coil so as to be cooled by refrigerant in said refrigerant chamber, then through said first connecting tube to said second tube coil in said helmet so as to cool air flowing from said fan past said second tube coil, and then through said second connecting tube back to said base unit.

2. A cooling apparatus according to claim 1, wherein said base unit defines a pump chamber therein and said pump of said closed coolant transfer system is located in said pump chamber.

3. A cooling apparatus according to claim 2, including a battery in said pump chamber for powering said pump.

4. A cooling apparatus according to claim 1, wherein said first and second connecting tubes are flexible.

5. A cooling apparatus according to claim 4, wherein said first and second connecting tubes are made of rubber.

6. A cooling apparatus according to claim 1, wherein said first and second tube coils are made of rigid material.

7. A cooling apparatus according to claim 6, wherein said first and second tube coils are made of metal.

8. A cooling apparatus according to claim 7, wherein said first and second tube coils are made of copper.

9. A cooling apparatus according to claim 1, wherein said base unit includes a harness for attaching said insulated container to a user as a backpack.

10. A cooling apparatus according to claim 1, wherein said helmet includes a dome having perforations for the inflow of ambient air.

11. A cooling apparatus according to claim 10, wherein said fan includes a battery-operated motor.

12. A cooling apparatus according to claim 11, wherein said helmet includes an internal band having a conical upper portion for directing air flowing from said fan to the peripheral interior of the helmet and over the face, sides and rear of the user's head.

13. A cooling apparatus according to claim 9, including a drainage valve in a bottom wall of said insulated container for draining liquid out of said refrigerant chamber.

14. A cooling apparatus according to claim 9, including an opening in a top wall of said insulated container for enabling refrigerant to be supplied into said refrigerant chamber, and a cap for closing said opening.

15. A cooling apparatus according to claim 9, including first and second T-connectors extending through said insulated container and respectively connected to said first and second connecting tubes, said first and second T-connectors including respective side branches with valves to enable coolant to be added to said closed circulation system or drained therefrom.

16. A cooling apparatus according to claim 1, wherein said refrigerant is ice.

17. A cooling apparatus according to claim 1, wherein said coolant is water.

18. A cooling apparatus according to claim 1, wherein said first coil is helical.

19. A cooling apparatus which comprises:

a base unit which includes an insulated container that provides a refrigerant chamber therein, a downwardly-open hood which defines an outlet opening and which includes a fan therein for creating air flowing out of said outlet opening, and a closed coolant circulation system for transferring coolness from refrigerant in said refrigerant chamber to the air flowing out of said downwardly-open hood, said closed coolant circulation system comprising a first tube coil in said refrigerant chamber; a second tube coil in said downwardly-open hood between said fan and said outlet opening, said second tube coil being helical; first and second connecting tubes extending between said base unit and said discharge unit; and a pump for circulating liquid coolant through said first tube coil so as to be cooled by refrigerant in said refrigerant chamber, then through said first connecting tube to said second tube coil in said downwardly-open hood so as to cool air flowing from said fan past said second tube coil, and then through said second connecting tube back to said base unit.

20. A cooling apparatus according to claim 19, wherein said first tube coil is helical.

* * * * *